US005314635A

United States Patent [19]

Hage et al.

[11] Patent Number: 5,314,635

[45] Date of Patent: May 24, 1994

[54] BLEACH ACTIVATION

[75] Inventors: Ronald Hage, Leiden; Jan E. Iburg, Vlaardingen, both of Netherlands

[73] Assignee: Lever Brothers Company, Division of Conopco, Inc., New York, N.Y.

[21] Appl. No.: 992,215

[22] Filed: Dec. 19, 1992

[30] Foreign Application Priority Data

Dec. 20, 1991 [GB] United Kingdom ..... 9127060
Mar. 4, 1992 [GB] United Kingdom ..... 9204706

[51] Int. Cl.[5] ..... C11D 3/28; C11D 3/39; C11D 3/395; D06L 3/02

[52] U.S. Cl. ..... 252/102; 8/107; 8/111; 252/98; 252/133; 252/186.31; 252/186.33; 252/186.39; 252/524; 252/542; 502/150; 502/167

[58] Field of Search ..... 252/102, 98, 186.31, 252/186.33, 186.39, 133, 524, 542; 8/111, 107

[56] References Cited

U.S. PATENT DOCUMENTS

| | | | |
|---|---|---|---|
| 4,088,595 | 5/1978 | Michelson et al. | 252/95 |
| 4,539,132 | 9/1985 | Oakes | 252/95 |
| 4,626,373 | 12/1986 | Finch et al. | 252/96 |
| 4,702,998 | 10/1987 | Tanaka | 430/430 |
| 4,728,455 | 3/1988 | Rerek | 252/99 |
| 4,810,410 | 3/1989 | Kiakun | 252/102 |
| 5,153,161 | 10/1992 | Kerschner | 252/186.41 |
| 5,194,416 | 3/1993 | Jureller | 8/111 |
| 5,244,594 | 9/1993 | Favre | 252/186.33 |
| 5,246,612 | 9/1993 | Van Dijk | 252/102 |
| 5,246,621 | 9/1993 | Favre | 252/186.33 |

FOREIGN PATENT DOCUMENTS

| | | |
|---|---|---|
| 42939/89 | 5/1990 | Australia . |
| 0306089 | 3/1989 | European Pat. Off. . |
| 0414581 | 2/1991 | European Pat. Off. . |
| 0458397 | 11/1991 | European Pat. Off. . |
| 0458398 | 11/1991 | European Pat. Off. . |

OTHER PUBLICATIONS

European Search Report, Apr. 1, 1993.
Journal of Colloid and Interface Science, vol. 69, No. 2, 1979, pp. 341-343 (Yoshikiyo Moroi et al), Apr. 1979.
J. Am. Che M. Soc. (Weighardt et al) 1988, vol. 110, pp. 7398-7411 (No month available).
J. Chem. Soc. Chem. Comm. (Weighart et al) 1988, pp. 1145-1146 (No month available).

*Primary Examiner*—Dennis Albrecht
*Attorney, Agent, or Firm*—Milton L. Honig

[57] ABSTRACT

A bleaching/cleaning composition is provided that includes a surfactant, a peroxy bleach compound and a ligand L which is a macrocyclic organic compound of formula:

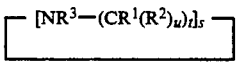

(I)

wherein:
t is an integer from 2 to 3;
s is an integer from 3 to 4;
$R^1$, $R^2$ and $R^3$ are each independently hydrogen, alkyl, aryl or a substituted alkyl or aryl.

The preferred ligand is 1,4,7-trimethyl-1,4,7-triazacyclononane.

20 Claims, No Drawings

BLEACH ACTIVATION

BACKGROUND OF THE INVENTION

1. Field of the Invention

The invention relates to activation of bleaches employing peroxy compounds including hydrogen peroxide or hydrogen peroxide adducts, which liberate hydrogen peroxide in aqueous solution, and peroxy acids; to compounds that activate or catalyse peroxy compounds; to bleach compositions, including detergent bleach compositions, which contain a catalyst for peroxy compounds; and to processes for bleaching and/or washing substrates using the aforementioned types of compositions.

In particular, the invention is concerned with the use of a class of organic ligand molecules and, optionally, a source of iron and/or manganese ions as a catalyst for bleach activation of peroxy compound bleaches.

2. The Related Art

Complexes having the general formula:

$$]L_nMn_m X_p]^z Y_q \quad (A)$$

wherein Mn is manganese which can be either in the II, III, IV or V oxidation state, or mixtures thereof; n and m are independent integers from 1–4; X represents a coordinating or bridging species; p is an integer from 0–12; Y is a counter-ion, the type of which is dependent upon the charge z of the complex; z is the charge of the complex and is an integer which can be positive, zero or negative; $q={}^{z}/$[charge Y]; and L is a ligand being a macrocyclic molecule of general formula:

$$\left[D-(CR^1R^2)_t+D-(CR^1R^2)_{t'}\right]$$

wherein $R^1$ and $R^2$ can each independently be zero, H, alkyl, or a substituted alkyl; each D can independently be N, NR, PR, O or S wherein R is H, alkyl, aryl or a substituted alkyl or aryl, t and t' are each independently 2 or 3, and s is 2,3,4 or 5, have been described in EP-A-0,458,397 as effective catalysts for bleaching with peroxy compounds.

SUMMARY OF THE INVENTION

It has now surprisingly been found that individual components of the complex described in the aforementioned reference may, by themselves, or when incorporated into a detergent formulation, be used as a bleach catalyst for peroxy compounds in the same way as the dinuclear complexes described in European Patent Specification Nos. 458 397 and 458 398.

It is an object of the present invention to provide an improved bleach catalyst for the bleach activation of oxidants, especially peroxy compounds, including hydrogen peroxide and hydrogen peroxide-liberating or -generating compounds, as well as peroxyacid compounds including peroxyacid precursors, over a wide class of stains at lower temperatures.

Another object of the invention is to provide an improved bleaching composition which is effective at low to medium temperatures of e.g. 10–40° C.

Still another object of the invention is to provide new, improved detergent bleach formulations, which are especially effective for washing at lower temperatures.

Yet another object of the invention is to provide an aqueous laundry wash media containing new, improved detergent bleach formulations.

A further object of the invention is to provide an improved bleaching system comprising a peroxy bleach compound and a bleach catalyst for the effective use in the washing and bleaching of substrates, including laundry, hard surfaces (such as in machine dishwashing, general cleaning etc.), and in the textile, paper and woodpulp industries and other related industries.

The catalysts of the invention may also be used in the peroxide oxidation of a broad range of organic molecules such as olefins, alcohols, aromatic ethers, sulphoxides and various dyes, and also for inhibiting dye transfer in the laundering of fabrics.

DETAILED DESCRIPTION

According to the present invention a cleaning composition comprises a surface active material and a ligand L of formula $$\left[NR^3-(CR^1(R^2)_u)_t\right]_s \quad (I)$$

wherein:

t is an integer from 2 to 3;

s is an integer from 3 to 4;

u is zero or one;

$R^1$, $R^2$ and $R^3$ are each independently selected from hydrogen, alkyl, aryl, both optionally substituted In addition, the composition of the invention may also contain a source of iron and/or manganese ions. Preferred compositions contain a surface active material, a ligand and a source of manganese ions.

Examples of suitable ligands in their simplest forms are:

1,4,7-triazacyclononane;
1,4,7-triazacylclodecane;
1,4,8-triazacycloundecane;
1,5,9-triazacyclododecane.
1,4,7-trimethyl-1,4,7-triazacyclononane
1,4,7-trimethyl-1,4,7-triazacyclodecane;
1,4,8-trimethyl-1,4,8-triazacycloundecane; and
1,5,9-trimethyl-1,5,9-triazacyclododecane.

all optionally substituted on amine N-atom and/or $CH_2$ carbon atom and/or aromatic ring.

Of these the following ligands and their carbon-substituted derivatives are preferred:

(1) 1,4,7-triazacyclononane (TACN);
(2) 1,4,7-trimethyl-1,4,7-triazacyclononane (1,4,7-$Me_3$-TACN)
(3) 2-methyl-1,4,7-triazacyclononane (2-MeTACN)
(4) 1,2,4,7-tetramethyl-1,4,7-triazacyclononane (1,2,4,7-$Mep_4$TACN)
(5) 1,2,2,4,7-pentamethyl-1,4,7-triazacyclononane (1,2,2,4,7-$Me_5$TACN)
(6) 2-benzyl-1,4,7-trimethyl-1,4,7-triazacyclononane
(7) 2-decyl-1,4,7-trimethyl-1,4,7-triazacyclononane Preferred ligands are those in which t is 2; s is 3; u is 1; $R^1$, $R^2$ and $R^3$ are each independently H or $CH_3$ and, more preferably, those in which $R^1$ and $R^2$ are both H and $R^3$ is $CH_3$.

The aforementioned ligands may be synthesised by the methods described in K Wieghardt et al., Inorganic Chemistry 1982, 21, page 3086 et seq, incorporated herein by reference.

The ligand will preferably be incorporated in the compositions of the invention in the form of an acid salt, such as the HCl or $H_2SO_4$ salt for example 1,4,7-$Me_3$-TACN hydrochloride.

The source of iron and/or manganese ions should be such that the ions are not too tightly bound therefore allowing interaction between said ions and the ligand of formula (I), as hereinbefore defined. Without being bound by theory, it is believed that the ligands extract metal from the manganese and iron sources in the bleaching solution. Preferred sources of iron and manganese ions are a water-soluble salt, such as iron (III) nitrate, manganese nitrate, manganese chloride, manganese sulphate or manganese acetate, or a coordination complex such as manganese acetylacetonate or manganese ethylene diaminetetraacetic acid. The source of iron and/or manganese ions may be added in liquid form or adsorbed onto a zeolite.

When the composition according to the invention is used in for example, a detergent formulation or textile treatment formulation it is not always necessary that the source of iron and/or manganese ions is included in the formulation. Without being bound by theory, it is believed that in such cases iron and/or manganese ions are picked up from the articles being treated. However, the formulation is more effective if a source iron and/or of manganese ions is included.

Preferably, the cleaning composition according to the invention further comprises a peroxy compound.

The composition of the invention may also include mono or dinuclear manganese complexes of formula (A)

$$[L_nMn_mX_p]^z Y_q \quad (A)$$

wherein n and m are independently 1 or 2;

p is an integer from 1 to 3 z denotes the charge of the complex and is an integer which can be positive, zero or negative;

Y is a counterion the type of which is dependent upon the charge z of the complex; $q=z/[\text{charge } Y]$;

Mn is manganese in the II, III or IV oxidation state or mixtures thereof; and

X is a coordinating or bridging species, such as $CH_3COO^-$, $O_2^{2-}$, $O^{2-}$ or mixtures thereof, and L is a ligand of formula (B)

$$\left[\!\left[ NR^3-(CR^1R^2)_t \right]\!\right]_s \quad (B)$$

wherein:

t is an integer from 2 to 3;

s is an integer from 3 to 4; and;

$R^1$, $R^2$ and $R^3$ are each independently hydrogen, alkyl, aryl; or a substituted alkyl or aryl. Preferably, these complexes, if included in the compositions, are present at levels from 0.0005 to about 0.5% by weight, i.e. at similar levels to those of the source of iron and/or manganese ions.

Such mononuclear complexes are further described in U.S. Pat. No. 5,194,416.

The dinuclear complexes are further described in Applicants copending European Patent Specifications 458 397 and 458 398.

The composition of the present invention finds particular application in detergent formulations.

Thus according to another aspect of the invention there is provided a detergent composition comprising a surface-active material, a peroxy compound, optionally a source of iron and/or manganese ions, a ligand of formula (I) as hereinbefore defined and optionally other detergent additives such as builders.

One advantage of the present invention over those compositions described, in particular, in European Patent Specifications 458 397, 458 398, and Applicants copending British Patent Applications 9127060.3 and 91203078.0 and U.S. Pat. No. 5,194,416 is that they are more cost effective. Whereas in the aforementioned references, it is necessary to complex the ligand with a metal and then add it to the detergent composition, in the detergent compositions of the present invention the ligand may be added directly to the composition. Furthermore, the mono and dinuclear complexes often have as their counterion $PF_6^-$. In the present invention potential problems associated with the inclusion of a phosphorus containing counterion in a detergent composition are avoided.

Furthermore, in detergent formulations the ligand may also function, in the absence of a source of iron and/or manganese ions, by sequestration of transition metal ions, thereby stabilising peroxy bleach systems, such as peracids or peracid precursors.

An advantage of the compositions of the invention is that they are hydrolytically and oxidatively stable and function in a variety of detergent formulations. They enhance the bleaching action of not only hydrogen peroxide bleaching agents but also of organic and inorganic peroxyacid compounds.

The compositions according to the invention when they also comprise a bleaching agent are effective on a wide range of stains including both hydrophilic and hydrophobic stains.

A further surprising feature is that they are compatible with detergent enzymes, such as proteases, cellulases, lipases, amylases, oxidases etc.

Accordingly, in further aspect, the invention provides a method of bleaching stained substrate, the method comprising contacting the stained substrate in aqueous media with a bleaching agent selected from the group of peroxy compound bleaches including hydrogen peroxide, hydrogen peroxide-liberating or generating compounds, peroxyacids and their salts, and peroxyacid bleach precursors and mixtures thereof, a ligand of formula (I) as hereinbefore defined and optionally a source of iron and/or manganese ions, each in an effective amount to interact with one another and provide a cleaning effect upon the substrate.

The effective level of ligand, expressed in terms of parts per million (ppm) of ligand in an aqueous bleaching solution will normally range from 0.003 ppm to 300 ppm, preferably from 0.03 ppm to 60 ppm, most preferably from 0.3 ppm to 30 ppm. The effective level of the source of iron and/or manganese ions, expressed in terms of parts per million (ppm) of the iron and/or manganese in an aqueous bleaching solution, will normally range from 0.001 ppm to 100 ppm, preferably from 0.01 ppm to 20 ppm, most preferably from 0.1 ppm to 10 ppm. Higher levels may be desired and applied in industrial bleaching processes, such as textile and paper pulp-bleaching. The lower levels quoted are primarily intended and preferably used in domestic laundry operations.

When both the ligand and source of iron and/or manganese ions are present in a composition the mole ratio of ligand to iron and/or manganese ion source is preferably within the range 1:1 to 100:1.

If the bleaching or cleaning composition itself contains or if it is to be used in the presence of a source of transition metal ions other than manganese or iron, either the mole ratio of ligand to source of iron and/or manganese ions should be greater than 1:1, or an additional transition metal sequestrant should be present.

Compositions comprising a peroxy compound bleach and the bleach catalyst i.e. the ligand of general formula (I) as hereinbefore defined and, optionally, a source of iron and/or manganese ions are effective over a wide pH range of between 7 and 13, with optimal pH range lying between 8 and 11.

As stated above, the peroxy bleach compounds which can be utilized in the bleaching composition and detergent bleach composition of the present invention include hydrogen peroxide, hydrogen peroxide-liberating compounds, hydrogen peroxide-generating systems, peroxyacids and their salts, and peroxyacid bleach precursor systems, and mixtures thereof.

Hydrogen peroxide sources are well known in the art. They include the alkali metal peroxides, organic peroxide bleaching compounds such as urea peroxide, and inorganic persalt bleaching compounds, such as the alkali metal perborates, percarbonates, perphosphates persilicates and persulphates. Mixtures of two or more of such compounds may also be used. Particularly preferred are sodium percarbonate and sodium perborate and, especially, sodium perborate monohydrate. Sodium perborate monohydrate is preferred to sodium perborate tetrahydrate because of its excellent storage stability combined with its ability to dissolve very quickly in aqueous bleaching solutions. Sodium percarbonate may be preferred for environmental reasons.

Alkylhydroxy peroxides are another class of peroxide bleaching agents. Examples of these materials include cumene hydroperoxide and t-butyl hydroperoxide.

Organic peroxyacids may also be suitable as the peroxide bleaching agent. Such materials normally have the general formula:

$$HOO-\overset{\overset{\displaystyle O}{\|}}{C}-R-Y$$

wherein R is an alkylene or substituted alkylene group containing from 1 to about 20 carbon atoms, optionally having an internal amide linkage; or a phenylene or substituted phenylene group; and Y is hydrogen, halogen, alkyl, aryl, an imido-aromatic or non-aromatic group, a COOH or $$\underset{\underset{\displaystyle O}{\|}}{COOH}$$

group or a quaternary ammonium group.

Typical monoperoxy acids useful herein include, for example.

i) peroxybenzoic acid and ring-substituted peroxybenzoic acids, e.g. peroxy-α-naphthoic acid;
ii) aliphatic, substituted aliphatic and arylalkyl monoperoxyacids, e.g. peroxylauric acid, peroxystearic acid and N,N-phthaloylaminoperoxy caproic acid (PAP); and
iii) 6-octylamino-6-oxo-peroxyhexanoic acid.

Typical diperoxyacids useful herein include, for example:

iv) 1,12-diperoxydodecanedioic acid (DPDA);
v) 1,9-diperoxyazelaic acid;
vi) diperoxybrassilic acid; diperoxysebasic acid and diperoxyisophthalic acid;
vii) 2-decylperoxybutane-1, 4-dioic acid;
viii) 4,4'-sulphonylbisperoxybenzoic acid.

Also inorganic peroxyacid compounds are suitable, such as for example potassium monopersulphate (MPS).

All these peroxide compounds may be utilized alone or in conjunction with a peroxyacid bleach precursor and/or an organic bleach catalyst. An advantage of using a peroxyacid bleach precursor is that it may improve the overall whiteness of white fabrics. Such materials may also be used because of the hygiene benefits they confer on materials treated therewith.

Peroxyacid bleach precursors are known and amply described in literature, such as in British Patents 836,988; 864,798; 907,356; 1,003,310 and 1,519,351; German Patent 3,337,921; European Patent Specification Nos 0185522; 0174132 and 0120591; and U.S. Pat. Nos. 1,246,339; 3,332,882; 4,128,494; 4,412,934 and 4,675,393.

Another useful class of peroxyacid bleach precursors are the quaternary ammonium substituted peroxyacid precursors disclosed in U.S. Pat. Nos. 4,751,015 and 4,397,757, and in European Patent Specification Nos 284,292, 331,229 and 303,520. Examples of peroxyacid bleach precursors of this class are:

2-(N,N,N-trimethyl ammonium) ethyl-4-sulphophenyl carbonate - (SPCC);
N-octyl,N,N-dimethyl-N10-carbophenoxy decyl ammonium chloride-(ODC);
3-(N,N,N-trimethyl ammonium) propyl sodium-4-sulphophenyl carboxylate; and
N,N,N-trimethyl ammonium toluyloxy benzene sulphonate.

A further special class of cationic peroxyacid bleach precursors is formed by the cationic nitriles as disclosed in European Patent Specification No 303520, 458396 and 464880.

Any one of these peroxyacid bleach precursors may be used in the present invention. Of the above classes of bleach precursors, the preferred materials are esters, including acyl phenol sulphonates and acyl alkyl phenol sulphonates; the acyl-amides; the quaternary ammonium substituted peroxyacid precursors including the cationic nitriles.

Examples of said preferred peroxyacid bleach precursors or activators are sodium-4-benzoyloxy benzene sulphonate (SBOBS); N,N,N'N'-tetraacetyl ethylene diamine (TAED); sodium-1-methyl-2-benzoyloxy benzene-4-sulphonate; sodium4-methyl-3-benzoyloxy benzoate; SPCC; trimethyl ammonium toluyloxy-benzene sulphonate; sodium nonanoyloxybenzene sulphonate (SNOBS); sodium 3,5,5-trimethyl hexanoyloxybenzene sulphonate (STHOBS); and the substituted cationic nitriles.

Other suitable precursors are the so-called sulphonimides as disclosed in European Patent Specification Nos 453,003 and 446,982.

A detergent bleach composition of the invention can be formulated by combining effective amounts of the components. The term "effective amounts"0 as used herein means the components are present in quantitites such that each of them is operative for its intended purpose when the resulting mixture is combined with water to form an aqueous medium which may be used to wash and clean clothes, fabrics and other articles.

In particular, the detergent bleach composition can be formulated to contain, for example, from about 2% to 30% by weight, preferably from 5 to 25% by weight, of a peroxide compound.

Peroxyacids may be used in somewhat lower amounts, for example from 1% to about 15% by weight, preferably from 2% to 10% by weight.

Peroxyacid precursors may be used in combination with a peroxide compound at approximately the same level as peroxyacids, i.e. 1% to 15%, preferably from 2% to 10% by weight.

The ligand and, optionally, the source of iron and/or manganese ions will be present in the bleach and detergent bleach compositions in amounts so as to provide the required level of ligand and metal ions in the wash liquor. Normally, an amount of ligand is incorporated in the composition from 0.0015% to about 1.5% by weight, preferably 0.003% to 0.75% by weight, and the amount of iron and/or manganese ion source incorporated is from 0.0005% to about 0.5% by weight, preferably 0.001% to 0.25% by weight.

When used in a detergent bleach composition to be dosed at low levels, for example by Japanese and U.S. consumers at dosages of about 1 and 2 g/l respectively the ligand content is 0.0075 to 1.5% by weight preferably 0.015 to 0.75% by weight, and the iron and/or manganese is present at 0.0025 to 0.5% by weight, preferably 0.005 to 0.25%. At higher product dosages as used, for example, by European consumers, the ligand content in the composition is 0.0015 to 0.3% by weight, preferably from 0.003 to 0.15% and the iron and/or manganese present at 0.0005 to 0.1% by weight, preferably from 0.001 to 0.05%.

The bleach catalyst of the invention is compatible with substantially any known and common surface-active agents and detergency builder materials.

The surface-active material may be naturally derived, such as soap, or a synthetic material selected from anionic, nonionic, amphoteric, zwitterionic, cationic actives and mixtures thereof. Many suitable actives are commercially available and are described in the literature, for example in "Surface Active Agents and Detergents", Volumes I and II, by Schwartz, Perry and Berch. The total level of the surface-active material may be up to 50% by weight, and is preferably from about 1% to 40% by weight of the composition, most preferably 4 to 25% by weight.

Synthetic anionic surface-actives are usually water-soluble alkali metal salts of organic sulphates and sulphonates having alkyl groups containing from about 8 to 22 carbon atoms, the term alkyl being used to include the alkyl portion of higher aryl groups.

Examples of suitable synthetic anionic detergent compounds are sodium and ammonium alkyl sulphates, especially those obtained by sulphating higher ($C_8$–$C_{18}$) alcohols produced, for example, from tallow or coconut oil; sodium and ammonium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those esters of the higher alcohols derived from tallow or coconut oil and synthetic alcohols derived from petroleum; sodium coconut oil fatty acid monoglyceride sulphates and sulphonates; sodium and ammonium salts of sulphuric acid esters of higher ($C_9$–$C_{18}$) fatty alcohol alkylene oxide, particularly ethylene oxide, reaction products; the reaction products of fatty acids such as coconut fatty acids esterified with isethionic acid and neutralised with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolyzing with a base to produce a random sulphonate; sodium and ammonium $C_7$–$C_{12}$ dialkyl sulfosuccinates; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkylbenzene sulphonates, sodium ($C_{16}$–$C_{18}$) alkyl sulphates and sodium ($C_{16}$–$C_{18}$) alkyl ether sulphates.

Examples of suitable nonionic surface-active compounds which may be used, include, in particular, the reaction products of alkylene oxides, usually ethylene oxide, with alkyl ($C_6$–$C_{22}$) phenols, generally 5–25 EO, i.e. 5–25 units of ethylene oxides per molecule; the condensation products of aliphatic ($C_8$–$C_{18}$) primary, secondary linear or branched alcohols with ethylene oxide, generally 3–30 EO, and products made by condensation of ethylene oxide with the reaction products of propylene oxide and ethylene diamine. Other so-called nonionic surface-actives include alkyl polyglycosides, long chain tertiary amine oxides, long chain tertiary phosphine oxides and dialkyl sulphoxides.

Amounts of amphoteric or zwitterionic surface-active compounds can also be used in the compositions of the invention but this is not normally desired owing to their relatively high cost. If amphoteric or zwitterionic detergent compounds are used it is generally in small amounts in compositions based on the much more commonly used synthetic anionic and nonionic actives.

As stated above, soaps may also be incorporated in the compositions of the invention. However, the bleach performance of the bleaching and detergent bleach composition is improved if the amount of long-chain $C_{16}$–$C_{22}$ fatty acid soaps is kept to a minimum. Short chain $C_{12}$–$C_{14}$ fatty acid soaps may be included preferably at levels not more than about 10% by weight.

High levels of anionic surfactant are also believed to reduce bleach performance to below optimum levels.

Preferably the detergent bleach composition comprises a surface-active material, a peroxy compound, a ligand of general formula (I) as hereinbefore defined, optionally a source of iron and/or manganese ions, 0 to 25% by weight of anionic surfactant and 7.5 to 55% by weight of nonionic surfactant, the weight ratio of nonionic surfactant to anionic surfactant being at least 0.75.

The detergent bleach composition of the invention will normally also contain a detergency builder. Builder materials may be selected from calcium sequestrant materials; precipitating materials; calcium ion-exchange materials and mixtures thereof.

Examples of calcium sequestrant builder materials include alkali metal polyphosphates, such as sodium tripolyphosphate; nitrilotriacetic acid and its water-soluble salts; the alkali metal salts of ether polycarboxylates, such as carboxymethyloxy succinic acid, oxydisuccinic acid, mellitic acid; ethylene diamine tetraacetic acid; benzene polycarboxylic acids; citric acid; and polyacetal carboxylates as described in U.S. Pat. Nos. 4,144,226 and 4,146,495.

Examples of precipitating builder materials include sodium orthophosphate, sodium carbonate and sodium carbonate/ calcite.

Examples of calcium ion-exchange builder materials include the various types of water-insoluble crystalline or amorphous aluminosilicates, of which zeolites are well-known examples.

In particular, the compositions of the invention may contain any one of the organic or inorganic builder materials, such as sodium or potassium tripolyphosphate, sodium or potassium pyrophosphate, sodium or potassium orthophosphate, sodium carbonate or sodium carbonate/calcite mixtures, the sodium salt of nitrilotriacetic acid, sodium citrate, carboxymethyl malonate, carboxymethyloxy succinate and the water-insoluble crystalline or amorphous aluminosilicate builder materials, or mixtures thereof.

If a phosphate builder is used, preferably a peroxyacid is present as the bleach agent.

The builder materials may be present at a level of, for example, from 5 to 80% by weight, preferably from 10 to 60% by weight.

The detergent compositions of the invention may also contain conventional additives in the amounts at which such materials are normally employed in fabric washing detergent compositions. Examples of these additives include buffers such as carbonates, lather boosters, such as alkanolamides, particularly the monoethanol amides derived from palmkernel fatty acids and coconut fatty acids, lather depressants, such as alkyl phosphates and silicones, anti-redeposition agents, such as sodium carboxymethyl cellulose and alkyl or substituted alkyl cellulose ethers, other stabilizers, such as ethylene diamine tetraacetic acid (EDTA) and the phosphonic acid derivatives (i.e. Dequest® types), fabric softening agents, inorganic salts, such as sodium sulphate, and, usually present in very small amounts, fluorescent agents, perfumes, enzymes, such as proteases, cellulases, lipases, amylases and oxidases, germicides and colourants.

Of these additives, transition metal sequestrants, such as EDTA and the phosphoric acid derivatives, e.g. ethylene diamine tetra-(methylene phosphonate) EDTMP are particularly important.

Another optional but highly desirable additive with multifunctional characteristics is a polymeric material having a molecular weight of from 1,000 to 2,000,000 and which can be a homo- or co-polymer of acrylic acid, maleic acid, or salt or anhydride thereof, vinyl pyrrolidone, methyl-or ethyl-vinyl ethers, and other polymerisable vinyl monomers. Preferred examples of such polymeric materials are polyacrylic acid or polyacrylate; polymaleic acid/acrylic acid copolymer; 70:30 acrylic acid/hydroxyethyl maleate copolymer; 1:1 styrene/maleic acid copolymer; isobutylene/maleic acid and disobutylene/maleic acid copolymers; methyl- and ethyl-vinylether/maleic acid copolymers; ethylene/maleic acid copolymer; polyvinyl pyrrolidone; and vinyl pyrrolidone/maleic acid copolymer. Such a polymeric additive is usually present at a level from about 0.1% to about 3% by weight.

When using a hydroperoxide, such as sodium perborate or sodium percarbonate, as the bleaching agent, it is preferred that the composition contains not more than 5% by weight of carbonate, expressed as sodium carbonate, more preferably not more than 2.5% by weight to substantially nil, if the composition pH lies in the lower alkaline region of up to 10.

Detergent bleach compositions of the invention, when formulated as free-flowing particles, e.g. in powdered or granulated form, can be produced by any of the conventional techniques employed in the manufacture of detergent compositions, for instance by slurry-making, followed by spray-drying, to form a detergent base powder to which heat-sensitive ingredients including the peroxy compound bleach, conventional additives, and the ligand and source of iron and/or manganese ions can be added as dry substances.

It will be appreciated, however, that the detergent base powder compositions, to which the ligand and source of iron and/or manganese ions is added, can itself be made in a variety of other ways, such as the so-called part-part processing, non-tower route processing, dry-mixing, agglomeration, granulation, extrusion, compacting and densifying processes etc., such ways being well known to those skilled in the art and not forming an essential part of the present invention.

Alternatively, the ligand and optionally source of iron and/or manganese ions may be added separately to a wash/bleach water containing the peroxy bleaching agent.

In that case, the ligand and, optionally source of iron and/or manganese ions is included as a detergent additive product. Such additive products are intended to supplement or boost the performance of conventional detergent compositions and may contain any of the components of such compositions, although they will not comprise all of the components present in a fully formulated detergent composition. Additive products in accordance with this aspect of the invention will normally be added to an aqueous liquor containing a source of (alkaline) hydrogen peroxide, although in certain circumstances the additive product may be used as separate treatment in a pre-wash or in the rinse.

Additive products in accordance with this aspect of the invention may comprise the ligand and, optionally, the source of iron and/or manganese ions alone or, preferably, in combination with a carrier, such as a compatible aqueous or non-aqueous liquid medium or a particulate substrate or a flexible non-particulate substrate.

Examples of compatible particulate substrates include inert materials, such as clays and other aluminosilicates, including zeolites, both of natural and synthetic origin. Other compatible particulate carrier materials include hydratable inorganic salts, such as carbonates and sulphates.

The ligand and, optionally, source of iron and/or manganese ions can also be formulated in detergent bleach compositions of other product forms, such as flakes, tablets, bars and liquids and particularly non-aqueous liquid detergent compositions.

Such non-aqueous liquid detergent compositions in which the ligand and, optionally, source of iron and/or manganese ions may be incorporated are known in the art and various formulations have been proposed, e.g. in U.S. Pat. Nos. 2,864,770; 3,368,977; 4,772,412; GB Patents 1,205,711; 1,370,377; 2,914,536; DE-A-2,233,771 and European Patent Specification No. 0,028,849.

These are compositions which normally comprise a non-aqueous liquid medium, with or without a solid phase dispersed therein. The non-aqueous liquid medium may be a liquid surfactant, preferably a liquid nonionic surfactant; a non-polar liquid medium, e.g. liquid paraffin; a polar solvent, e.g. polyols, such as glycerol, sorbitol, ethylene glycol, optionally combined with low-molecular monohydric alcohols, e.g. ethanol or isopropanol; or mixtures thereof.

The solid phase can be builders, alkalis, abrasives, polymers, clays, other solid ionic surfactants, bleaches, fluorescent agents and other usual solid detergent ingredients.

When a source of iron or manganese ions is used, the source should be protected to prevent the formation of metal hydroxides or oxides.

Preferably the source of iron and/or manganese ions and the ligand will be granulated before being added to the compositions.

The invention will now be illustrated by way of the following examples:

EXAMPLES

Bleaching experiments were carried out with sodium perborate monohydrate on standard tea-stained test cloths.

The experiments were all carried out in a temperature-controlled glass beaker equipped with a magnetic stirrer, thermocouple and a pH electrode and at a constant temperature of 40° C. In the experiments either demineralised water or tap water (16° FH.) were used. Except where stated, demineralised water was used.

Two test cloths were immersed for 30 minutes in each of the compositions of the examples. After rinsing with tap water, the cloths were dried in a tumble drier. The reflectance ($R_{460*}$) was measured on a Zeiss Elrephometer before and after treatment. The difference ($\Delta R_{460*}$) in the values gives a measure of the effectiveness of the treatment. The ($\Delta R_{460*}$) results presented below are an average value for two test cloths.

In examples I-XIV and comparative examples A to H sodium perborate monohydrate was added to demineralised water and the pH of the solution adjusted to pH 10. (The level of sodium perborate monohydrate was such that it yielded hydrogen peroxide at a concentration of $8.6\times10^{-6}$ mol/l.). Thereafter the ligand, source of manganese ion and complex, as appropriate, were added to the solution. In examples in which both a ligand and a source of manganese ions were present, the ligand was first added followed by the manganese ion source. The resulting solution was stirred for one minute before addition of the rest cloths.

In examples XV to XX and comparative examples M, N, P and Q bleach catalysis was examined in a detergent powder formulation, the composition of which is given below. The formulation was dosed at a level of 5 g/l. The amount of sodium perborate monohydrate used was 17.5%, yielding a hydrogen peroxide concentration of $8.6\times10^{-6}$ mol/l. In these examples, sodium perborate monohydrate was added to a solution of the detergent formulation in tap water. Thereafter, the procedure was same as that described above for examples I-XIV.

Examples A-H, J-N and P-S are included for comparison purposes.

| Detergent Formulation | % |
|---|---|
| Anionic surfactant | 6 |
| Nonionic surfactant | 10 |
| Soap | 2 |
| NaOH | 1 |
| Zeolite | 27 |
| Polymer | 4 |
| Sodium carbonate | 12 |
| Sodium silicate | 1 |

-continued

| Detergent Formulation | % |
|---|---|
| Sodium carboxymethyl cellulose | 1 |
| Fluorescers | 1 |
| Antifoam | 1 |
| Sodium perborate monohydrate | 17.5 |
| Water and minors | 16.5 |

EXAMPLES I-VI

These examples illustrate the effect on bleach performance of a variation in the mole ratio of manganese ion source to ligand.

| Example | [1,4,7-$Me_3$TACN] $\times 10^{-6}$ mol/l | [Mn-nitrate] $\times 10^{-6}$ mol/l | $\Delta R_{460*}$ |
|---|---|---|---|
| A | 0 | 0 | 6.5 |
| B | 0 | 5 | 12 |
| I | 120 | 5 | 26 |
| II | 30 | 5 | 28 |
| III | 6 | 5 | 27 |
| IV | 3 | 5 | 24.5 |
| V | 2.5 | 120 | 24 |
| VI | 120 | 0 | 12 |
| C* | 0 | 0 | 26.5 |

*Composition contains $[Mn_2(\mu\text{-}0)_3(1,4,7\text{-}Me_3TACN)_2](PF_6)_2$ (at a level of $2.5\times10^{-6}$ mol/l equivalent to $5\times10^{-6}$ mol/l of Mn as described in European Patent Specification No. 458 397.

The results demonstrate:

i) When both ligand and $Mn^{II}$ are present in the composition there is an increase in the value of $\Delta R_{460*}$, for test cloths washed with that composition compared to test cloths washed with composition comprising either ligand or $Mn^{II}$ alone.

ii) Adding both ligand and $Mn^{II}$ separately to a composition gives comparable results to those obtained when a preformed Mn complex such as $[Mn_2(\mu\text{-}0)_3(1,4,7\text{-}Me_3TACN)_2](PF_6)_2$ is used.

EXAMPLES VII-XI

In the following examples the bleach performance of the ligand 1,4,7-$Me_3$TACN together with a series of different manganese ion sources was measured.

In each case, except comparative example A, the manganese ion source was present in such an amount that the effective level of Mn ions was $5\times10^{-6}$ mol/l and the level of the ligand 1,4,7-$Me_3$TACN was $120\times10^{-6}$ mol/l.

| Example | Manganese Source | $\Delta R_{460*}$ |
|---|---|---|
| A | blank (no Mn; no 1,4,7-$Me_3$TACN) | 6.5 |
| I | Mn-nitrate | 26 |
| VII[a] | Mn-hydroxide | 22 |
| VIII | Mn(II)-Acetylacetonate | 26.5 |
| IX | Mn(III)-Acetylacetonate | 26.5 |
| X | $[Mn_4(\mu\text{-}O)_6(TACN)_4](ClO_4)_4$ | 25 |
| XI | Mn(II)phtalocyanine | 23 |
| D[b] | $Mn(NO_3)_2$ + EDTA | 12.6 |
| E[c] | $Mn(NO_3)_2$ + Dequest | 9 |

[a]Mn-nitrate was added to NaOH solution. The resulting solution and precipitate was added as the source of Mn ions to the solution containing the ligand and sodium perborate monohydrate.

[b]17.7 mg $EDTANa_2$ and 1.3 mg $Mn(NO_3)_2$ were added to 1 liter of water. Thereafter, sodium perborate monohydrate was added and the pH adjusted to pH 10 and then MeTACN added. Test cloths were immersed in the resulting solution.

[c]As [b] except 4.4 mg of Dequest was used.

"Dequest is a Trademark for polyphosphonates ex Monsanto.

The above results show that bleach catalysis is also obtained when Mn-nitrate is replaced by other sources of Mn ions.

Addition of sequestrant, such as EDTA or Dequest, leads to a large decrease in bleaching. Without being bound by theory, it is believed this is because the sequestrant binds to the manganese ions preventing them from participating in the bleach catalysis.

EXAMPLE XII

In the following examples the bleach performance of the ligand 1,4,7-$Me_3TACN$ together with a series of different metal ions were measured.

In each case, except comparative example A, the concentration of metal ions was $5\times10^{-6}$ mol/l and the level of the ligand 1,4,7-$Me_3TACN$ was $120\times10^{-6}$ mol/l.

| Example | Metal Ion Source | $\Delta R_{460}$* |
|---|---|---|
| A | blank (no Mn; no 1,4,7-$Me_3TACN$) | 6.5 |
| I | Mn-nitrate | 26 |
| XII | Fe (III) nitrate | 15 |
| F | Co (II) nitrate | 11 |
| G | Ni (II) chloride | 11.5 |
| H | Zn (II) chloride | 12 |
| J | Ti (III) chloride | 11.5 |
| K | V (III) chloride | 12.5 |
| L | Cr (III) chloride | 11 |

The results show other metal ion sources, with the exception of iron ions, do not appear to be effective bleach catalysts when used in conjunction with the ligand 1,4,7-$Me_3TACN$.

EXAMPLES XIII-XIV

This example shows the effect on bleach performance of replacing demineralised water by tap-water.

In both cases, the concentration of manganese nitrate and the ligand 1,4,7-$Me_3TACN$ was $5\times10^{-6}$ mol/l.

| Example | | $\Delta R_{460}$* |
|---|---|---|
| XIII | demi-water | 26 |
| XIV | tap-water | 18 |

The results show bleach activity is reduced when tap-water is used.

EXAMPLES XV-XX

The following examples show the effect of different bleach catalysts in a detergent powder formulation.

| Example | Bleach catalyst (concentration in $\times 10^{-6}$ mol/l) | $\Delta R_{460}$* |
|---|---|---|
| M | blank (no Mn; no MeTACN) | 9 |
| N | Mn-nitate (5) | 11 |
| XV | 1,4,7-$Me_3TACN$ (120) | 17 |
| XVI | Mn-nitrate:1,4,7-$Me_3TACN$ (5:120) | 31 |
| XVII | Mn-nitrate:1,4,7-$Me_3TACN$ (5:30) | 31 |
| XVIII | Mn-nitrate:1,4,7-$Me_3TACN$ (5:6) | 17 |
| P | $[Mn(1,4,7\text{-}Me_3TACN)Cl_3]$ (5) | 15 |
| XIX | $[Mn(1,4,7\text{-}Me_3TACN)Cl_3]$ + 1,4,7-$Me_3TACN$ (5:120) | 32 |
| Q | $[Mn_2(\mu\text{-}O)_3(1,4,7\text{-}Me_3TACN)_2]^{2+}$ (2.5) | 24 |
| XX | $\{[Mn_2(\mu\text{-}O)_3(1,4,7\text{-}Me_3TACN)_2]^{2+}\}$ $\{+1,4,7\text{-}Me_3TACN\}$ (2.5:120) | 31 |

The results show that bleach catalysis is obtained in a detergent powder formulation.

The results also show when tap-water is used it is preferable to use an excess of the ligand. Without being bound by theory, it is believed free metal ions present in the tap-water bind at least some of the ligand leaving less free material to act in combination with the manganese ion source as a bleach catalyst.

EXAMPLE XXI

The following example illustrates the ligand 1,4,7-$Me_3TACN$ also acts as a bleach stabiliser.

Bleach stability was examined in the detergent powder formulation given above. The formulation was dosed at a level of 6 g/l. The sodium perborate monohydrate was replaced by a mixture of cholyl sulphophenyl carbonate (CSPC) (prepared as described in U.S. Pat. No. 4,751,015) and sodium perborate monohydrate present at levels of $1.2\times10^{-6}$ mol/l and $4.5\times10^{-6}$ mol/l respectively. In the examples sodium perborate monohydrate and CSPC were added to a solution of the detergent formulation in tap water. Thereafter the ligand MeTACN or Dequest (for the comparative example P) was added and the resulting solution stirred for one minute.

Bleaching experiments were carried out on standard tea-stained test cloths.

The experiments were carried out in a temperature-controlled glass beaker equipped with a magnetic stirrer, thermocouple and a pH electrode.

Two test cloths were immersed in the solutions which were heated at a temperature from 20 to 40° C. over 12 minutes. Thereafter, a constant temperature of 40° C. was maintained and the test cloths continued to be immersed for a further 38 minutes at this temperature.

The test cloths were then rinsed, dried and the reflectance measured as described above.

The time integrated molar fraction of peracid (PA ti mol fr) was also determined to give a measure of the stability of the peracid, i.e. choly sulphophenyl carbonate (CSPC).

This is defined as:

Area under peracid concentration versus time profile (i) as a function of the ideal profile, assuming no decomposition of the peracid during the experiment (i) is determined by measuring the peracid concentration, by titration as a function of time over 50 minutes and thereafter determining the area under the profile.

The following results were obtained:

EXAMPLE

| | Example | | XXI |
|---|---|---|---|
| Stabiliser present | R None | S Dequest ® | 1,4,7-$Me_3TACN$ Hydrochloride |
| % | | 0.30 | 0.19 |
| PA ti mol fr | 0.23 | 0.53 | 0.38 |
| $\Delta R_{460}$* | 17.5 | 26.9 | 26.0 |

The results show addition of the ligand salt 1,4,7-$Me_3TACN$ hydrochloride to a detergent formulation gives bleach performance which is comparable to that obtained when Dequest is added to the formulation. The advantage of adding ligand salt is that it also acts as a stabiliser for the peracid when compared to Dequest.

We claim:

1. A cleaning composition comprising from about 1 to 50% by weight of a surface active material and from 0.0015 to about 1.5% by weight of a ligand L, uncomplexed with manganese prior to addition to a wash medium, of formula (I):

$$[NR^3-(CR^1(R^2)_u)_t]_s \quad (I)$$

wherein:

t is an integer from 2 or 3:

s is an integer from 3 to 4;

u is zero or one;

$R^1$, $R^2$ and $R^3$ are each optionally substituted and independently selected from the group consisting of hydrogen alkyl, and aryl.

2. A composition according to claim 1 further comprising from about 2 to 30% by weight of a peroxy compound.

3. A composition according to claim 1 further comprising from 0.0005 to about 0.5% by weight of a mononuclear or dinuclear manganese complex of formula (A)

$$(L_nMn_mX_p)^z Y_q \quad (A)$$

wherein:

n and m are independently 1 or 2;

p is an integer from 1 to 3;

z denotes the charge of the complex and is an integer which can be positive, zero or negative;

Y is counterion the type of which is independent upon the charge z of the complex;

$$q=z/(\text{charge } Y);$$

Mn is manganese in the II, III or IV oxidation state or mixtures thereof;

X is a coordinating or bridging species; and

L is a ligand of formula (B)

$$[NR^3-(CR^1R^2)_t]_s \quad (B)$$

wherein:

t is an integer from 2 to 3;

s is an integer from 3 to 4;

$R^1$, $R^2$ and $R^3$ are each optionally substituted and independently selected from the group consisting of hydrogen, alkyl, and aryl.

4. A composition according to claims 1 in which in the ligand L t is an integer from 2 to 3, s is an integer from 3 to 4, u is zero or one and $R^1$, $R^2$ and $R^3$ are each independently selected from hydrogen, alkyl, and aryl, both optionally substituted.

5. A composition according to claim 1 further comprising a source of iron and/or manganese ions.

6. A composition according to claim 5 wherein the source of iron and manganese ions is selected from the group consisting of iron (III) nitrate, manganese nitrate, manganese chloride, manganese sulphate, manganese acetate, manganese acetylacetonate and manganese ethylenediaminetetracetic acid.

7. A composition according to claim 1 wherein the ligand is selected from the group consisting of 1,4,7-triazacyclononane; 1,4,7-trimethyl-1,4,7-triazacyclononane; 2-methyl-1,4,7-triazacyclononane; 1,2,4,7-tetramethyl-1,4,7-triazacyclononane; 1,2,2,4,7-pentamethyl-1,4,7-triazacyclononane; 2-benzyl-1,4,7-trimethyl-1,4,7-triazacyclononane; and 2-decyl-1,4,7-trimethyl-1,4,7-triazacyclononane.

8. A composition according to claim 1 wherein the ligand is 1,4,7-trimethyl-1,4,7-triacyclononane.

9. A bleaching composition comprising from about 2 to 30% by weight of a peroxy compound and from 0.0015 to about 1.5% by weight of a ligand L, uncomplexed with manganese prior to addition to a wash medium, of formula (I):

$$[NR^3-(CR^1(R^2)_u)_t]_s \quad (I)$$

wherein:

t is an integer from 2 or 3;

s is an integer from 3 or 4;

u is zero or one;

$R^1$, $R^2$ and $R^3$ are each optionally and independently selected from the group consisting of hydrogen, alkyl, and aryl.

10. A composition according to claim 9 wherein the ligand is selected from the group consisting of 1,4,7-triazacyclononane; 1,4,7-trimethyl-1,4,7-triazacyclononane; 2-methyl-1,4,7-triazacyclononane; 1,2,4,7-tetramethyl-1,4,7-triazacyclononane; 1,2,2,4,7-pentamethyl-1,4,7-triazacyclononane; 2-benzyl-1,4,7-trimethyl-1,4,7-triazacyclononane; and 2-decyl-1,4,7-trimethyl-1,4,7-triazacyclononane;

11. A composition according to claim 9 wherein the ligand is 1,4,7-trimethyl-1,4,7-triazacyclononane.

12. A method for bleaching a stained substrate the method comprising contacting the stained substrate in an aqueous medium containing an effective amount of the composition of claim 2, provide a cleaning effect upon the substrate and aryl.

13. A method according to claim 12 wherein the ligand is selected from the group consisting of 1,4,7-triazacyclononane; 1,4,7-trimethyl-1,4,7-triazacyclononane; 2-methyl-1,4,7-triazacyclononane; 1,2,4,7-tetramethyl-1,4,7-triazacyclononane; 1,2,2,4,7-pentamethyl-1,4,7-triazacyclononane; 2-benzyl-1,4,7-trimethyl-1,4,7-triazacyclononane; and 2-decyl-1,4,7-trimethyl-1,4,7-triazacyclononane.

14. A method according to claim 2 wherein the ligand is 1,4,7-trimethyl-1,4,7-triazacyclononane.

15. A detergent composition comprising i) from 2 to 30% by weight of a peroxy compound;

ii) up to 50% by weight of a surface-active material;

iii) from 0.0015 to about 1.5% by weight of a ligand, uncomplexed with manganese prior to addition to a wash medium, of formula (I)

$$[NR^3-(CR^1(R^2)_u)_t]_s \quad (I)$$

wherein:

t is an integer from 2 or 3;

s is an integer from 3 to 4;

u is zero or one;

$R^1$, $R^2$ and $R^3$ are each optionally substituted and independently selected from the group consisting of hydrogen, alkyl, and aryl.

16. A composition according to claim 15 further comprising a source or iron and/or manganese ions such that the ligand to ion source is present in a mole ratio of from 1:1 to 100:1.

17. A composition according to claim 15 wherein the ligand of formula (I) is present at a level from 0.003 to 300 ppm and the source of iron and/or manganese ions is present at a level from 0.001 to 100 ppm.

18. A composition according to claim 15 further comprising 5 to 80% by weight of a detergency builder.

19. A composition according to claim 15 wherein the ligand is selected from the group consisting of 1,4,7-triazacyclononane; 1,4,7-trimethyl-1,4,7-triazacyclononane; 2-methyl-1,4,7-triazacyclononane; 1,2,4,7-tetramethyl-1,4,7-triazacyclononane; 1,2,2,4,7-pentamethyl-1,4,7-triazacyclononane; 2-benzyl-1,4,7-trimethyl-1,4,7-triazacyclononane; and 2-decyl-1,4,7-trimethyl-1,4,7-triazacyclononane.

20. A composition according to claim 15 wherein the ligand is 1,4,7-trimethyl-1,4,7-triazacyclononane.

* * * * *